US011365741B2

(12) United States Patent
Gebert et al.

(10) Patent No.: US 11,365,741 B2
(45) Date of Patent: Jun. 21, 2022

(54) AXIAL FAN WITH INCREASED ROTOR DIAMETER

(71) Applicant: ebm-papst Mulfingen GmbH & Co. KG, Mulfingen (DE)

(72) Inventors: Daniel Gebert, Oehringen (DE); Thorsten Pissarczyk, Gemmingen (DE); Angelika Klostermann, Gaisbach (DE); Katrin Bohl, Künzelsau (DE); Markus Engert, Lauda-Königshofen (DE); Oliver Haaf, Kupferzell (DE); Marc Schneider, Dörzbach (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 270 days.

(21) Appl. No.: 15/325,782

(22) PCT Filed: Aug. 13, 2015

(86) PCT No.: PCT/EP2015/068646
§ 371 (c)(1),
(2) Date: Jan. 12, 2017

(87) PCT Pub. No.: WO2016/026762
PCT Pub. Date: Feb. 25, 2016

(65) Prior Publication Data

US 2017/0152854 A1 Jun. 1, 2017

(30) Foreign Application Priority Data

Aug. 18, 2014 (DE) ..... 10 2014 111 767.0

(51) Int. Cl.
*F04D 25/06* (2006.01)
*F04D 19/00* (2006.01)
(Continued)

(52) U.S. Cl.
CPC ..... *F04D 25/064* (2013.01); *F04D 19/002* (2013.01); *F04D 29/325* (2013.01);
(Continued)

(58) Field of Classification Search
CPC .... F04D 25/064; F04D 29/644; F04D 29/541; F04D 29/384; F04D 29/547;
(Continued)

(56) References Cited

U.S. PATENT DOCUMENTS 3,858,644 A * 1/1975 Beck ..... F01P 5/06 165/51
4,061,188 A * 12/1977 Beck ..... B60K 11/02 165/122

(Continued)

FOREIGN PATENT DOCUMENTS

DE 69105703 T2 10/1995
DE 69024820 T2 5/1996

(Continued)

OTHER PUBLICATIONS

International Search Report (in German with English Translation) for PCT/EP2015/068646, dated Nov. 13, 2015; ISA/EP.

*Primary Examiner* — David Hamaoui
(74) *Attorney, Agent, or Firm* — Harness, Dickey & Pierce, P.L.C.

(57) ABSTRACT

An axial fan for use with a wall ring plate includes a housing having an inlet region and a rotor. The rotor has an increased rotor diameter compared to a standardised rotor diameter. On the inlet side, the inlet region has a tapered section that narrows in an arched manner in a cross-sectional view from an inlet diameter to a wall ring diameter. The axial width and radial length of the tapered section are formed in a predetermined ratio.

10 Claims, 4 Drawing Sheets

(51) Int. Cl.

| | |
|---|---|
| ***F04D 29/32*** | (2006.01) |
| ***F04D 29/66*** | (2006.01) |
| ***F04D 29/52*** | (2006.01) |
| ***F04D 29/54*** | (2006.01) |
| ***F04D 29/38*** | (2006.01) |
| ***F04D 29/64*** | (2006.01) |

(52) U.S. Cl.
CPC ..... *F04D 29/384* (2013.01); *F04D 29/522* (2013.01); *F04D 29/541* (2013.01); *F04D 29/547* (2013.01); *F04D 29/644* (2013.01); *F04D 29/667* (2013.01)

(58) Field of Classification Search
CPC .... F04D 19/002; F04D 29/667; F04D 29/522; F04D 29/325
See application file for complete search history.

(56) References Cited

U.S. PATENT DOCUMENTS 4,173,995 A * 11/1979 Beck ..... B60K 11/02 123/41.49
4,189,281 A * 2/1980 Katagiri ..... F04D 29/547 123/41.49
4,221,546 A * 9/1980 Papst ..... F04D 29/545 415/207
4,566,852 A * 1/1986 Hauser ..... B01D 53/005 123/41.49
4,568,242 A * 2/1986 Susa ..... F04D 29/384 415/119
4,927,328 A * 5/1990 Scoates ..... F04D 29/547 123/41.49
5,248,224 A 9/1993 Amr
5,342,167 A * 8/1994 Rosseau ..... F04D 29/666 415/119
5,520,513 A * 5/1996 Kuroki ..... F04D 29/547 415/223
5,803,709 A * 9/1998 Matthews ..... F04D 29/545 415/182.1
6,045,327 A * 4/2000 Amr ..... F04D 25/08 415/191
7,037,077 B2 * 5/2006 Oono ..... F04D 29/164 416/169 A
7,377,751 B2 * 5/2008 Foster, Sr. ..... F04D 29/384 257/E23.099
7,839,038 B2 * 11/2010 Simofi-Ilyes ..... H02K 5/06 310/402
8,622,695 B2 * 1/2014 Decker ..... F04D 29/541 415/214.1
9,097,261 B2 * 8/2015 Haaf ..... F04D 29/329
9,551,356 B2 * 1/2017 Leesman ..... F04D 29/526
2010/0040458 A1 * 2/2010 Bushnell ..... F04D 29/164 415/173.6
2014/0086728 A1 3/2014 Engert et al.

FOREIGN PATENT DOCUMENTS

| | | | |
|---|---|---|---|
| DE | 202010016820 | U1 | 3/2012 |
| FR | 2728028 | A1 | 6/1996 |
| WO | WO-2008143603 | A1 | 11/2008 |
| WO | WO-2012084725 | A1 | 6/2012 |

* cited by examiner

AXIAL FAN WITH INCREASED ROTOR DIAMETER

CROSS REFERENCE TO RELATED APPLICATIONS

This application is a U.S. National Phase Application under 35 U.S.C. 371 of International Application No. PCT/EP2015/068646 filed on Aug. 13, 2015 and published in German as WO 2016/026762 A1 on Feb. 25, 2016. This claims priority to German Application No. 10 2014 111 767.0 filed on Aug. 18, 2014. The entire disclosures of all of the above applications are incorporated herein by reference.

FIELD

The invention relates to an axial fan for use with a wall ring plate, in particular in the areas of ventilation technology, air-conditioning technology and refrigerating technology.

BACKGROUND

The providing of fans with a wall ring plate as a structural unit is known from the prior art, wherein the dimensions of the wall ring plate are standardized in order to make it possible to exchange the devices by replacing the entire structural unit. New solutions for fans with a wall ring plate must therefore be designed in such a manner as concerns their dimensioning (length and width of the wall ring plate) that they can replace existing systems. They are therefore subject to restrictions conditioned by their structural space as regards length and width and must be able to make use of traditional EC and AC motors. Rotors with a diameter $D_{standard}$ based on the standard series R20 of DIN 323 or ISO 3 which is calculated according to the following formula are used for the fans:

$$D_{standard} = d_{n-1} \times \sqrt[20]{10}$$

$D_{standard}$ standard diameters of rotors are accordingly, for example, approximately 501 mm, 562 mm, 630 mm, 707 mm, etc. A tolerance of 2% can be taken into consideration.

In order to coordinate the unit consisting of fan and wall ring plate, the axial extension of the structural unit, i.e., in particular of the fan, motor and possible additional structural components, the dimensioning and geometry of the fan chamber in the wall ring plate and the rotor itself may be changed.

These changes are intended to improve the flow mechanics of traditional axial fans in order to increase their efficiency and the air power of previously used motors by reducing the torque requirement, and to enable the use of more economical motors with lower torque and reduced power consumption, which supply the air power in the same manner.

Basically, efficiency can be increased by reducing dynamic output losses (pressure recovery) as is described, among other things, in DE 202010016820U1. For example, a follower guide wheel or a diffusor can be provided in an axial fan as a structurally conditioned measure for influencing the flow as regards pitch and exit speed. However, such a downstream reconversion is never complete and is therefore less efficient as compared with measures inside the axial fan that result in a reduction of the speed in the rotor.

When external rotor motors are used, the hub is greater in diameter than the motor since the motor is seated inside the hub. However, a large hub increases the axial speed of the flow and with it the exit losses in axial fans given the same volume flow.

The air power of an axial fan can basically be increased by enlarging the rotor. However, this has the problem that a distinct deterioration of the acoustics is produced when the structural space is retained on account of the use of a wall ring plate, the outside dimensions of which are defined by standards and on account of an increase in the diameter of the wall ring for the enlarged rotor. Therefore, in order to achieve an overall improvement of the dynamic flow, measures should be taken in the axial fan in the area of the rotor to reduce the dynamic exit losses and also to retain or even improve the acoustics.

SUMMARY

It is therefore the object of the disclosure to provide an axial fan which has improved efficiency over known systems without increased noise production, and which can be used as a direct replacement for an axial fan with a wall ring plate.

An axial fan, in particular a low-pressure axial fan, for use with a wall ring plate includes a motor, a housing with an inlet region and an outlet region and a rotor that can be driven by the motor, wherein the housing has on the inlet side an outer housing diameter $D_1$ and the rotor has a rotor diameter $D_L$ which is increased in comparison with a rotor diameter $D_{standard}$ which is standardized based on a DIN standard or ISO standard, in particular DIN 323 or ISO 3, so that a ratio of $D_1/D_L$ is less than a ratio of $D_1/D_{standard}$. The inlet region, as viewed on the inlet side and in the direction of flow, comprises a tapered section that narrows in an arched manner in a cross-sectional view from an inlet diameter $D_A$ to a wall ring diameter $D_{WR}$, the axial width b and radial length a of which tapered section form a ratio of a/b in a range of 0.3 to 0.7, preferably of 0.4 to 0.6, more preferably 0.5. The lateral cross section of the arched shape therefore forms a part of an oval, more preferably a part of an ellipse, in an advantageous embodiment.

The combination of an increase in the rotor diameter $D_L$ over the standardized rotor diameter with simultaneous adaptation of the inlet geometry produces the desired reduced torque requirement with acoustics that are not deteriorated. Increasing the rotor diameter increases the exit surface, as a result of which a reduction of the dynamic exit losses and an associated increase in efficiency are achieved. The possibility of enlarging the rotor while retaining the good acoustic behavior is achieved by the above-described inlet geometry.

It proved to be advantageous for the rotor diameter to be increased over the standardized rotor diameter by a factor g while the outside dimensions are retained, i.e. for $D_1$ and $D_L$:

$$D_1 = f \times D_{standard}$$

$$D_L = g \times D_{standard}$$

Here the factors g and f in a range $g_{min}$ to $g_{max}$ and in a range to $f_{min}$ to $f_{max}$ according to the disclosure are defined as $g_{min} = -0.00008 \times D_{standard} + 1.1$ and $g_{max} = -0.00022 \times D_{standard} + 1.34$, preferably $g_{max} = -0.00022 \times D_{standard} + 1.088$, and $f_{min} = -0.00022 \times D_{standard} + 1.35$, preferably $f_{min} = -0.00028 \times D_{standard} + 1.42$ and $f_{max} = -0.00028 \times D_{standard} + 1.5$, preferably $f_{max} = -0.00028 \times D_{standard} + 1.46$.

In particular, the disclosure relates to rotors with diameters of 350 to 1300 mm, more preferably 500 to 910 mm. The rotors themselves have 3 to 13, preferably 4 to 7 blades.

The housing of the axial fan is constructed according to the disclosure for improving the acoustics in such a manner that it has an inlet geometry in which a ratio j of the axial width b of the tapered section to the outside edge region extending radially vertically over the length c is defined in a range $j_{min}$ to $j_{max}$ as $$j_{min}=-0.0047\times D_{standard}+6.5225, \text{ and}$$

$$j_{max}=0.0054\times D_{standard}+8.8135, \text{ preferably } j_{max}=8.$$

An especially advantageous result with respect to the efficiency of the fan wheel with a static degree of efficiency $\eta>58\%$ (according to ISO 5801) and acoustics is achieved by the relationship of inlet geometry and rotor diameter in the cited range.

An alternative embodiment provides that a reinforcement web extending in an axial, radial or oblique direction is formed between the outside edge region and the tapered section and, in an advantageous variant of the embodiment, extends horizontally in the direction of flow or radially vertically. Such a "reinforcement corrugation" reinforces the housing in the inlet region and stabilizes the entire structural unit consisting of fan and wall ring plate.

As is known, dimensionless, strong rotors in which the static efficiency optimum lies in large values for the flow-through number $\varphi$ and the pressure number $\psi$, which are substantially influenced by the blade number and the angular position, are acoustically better than dimensionless, weak rotors. According to the disclosure, for especially positive acoustics it is optimal for the static efficiency optimum to lie at a value for the pressure number $\psi$ (according to standard ISO 5801) in a range which is defined as $$\psi\leq-0.0003\times D_{standard}+0.425,$$

preferably $$\psi<-0.0003\times D_{standard}+0.425.$$

The efficiency and the acoustics of the axial fan can be further improved by the forming of winglets on each of the rotor blades, in particular by an integral formation on the radial outer regions of the blades.

In order to be able to connect different motors with different motor diameters to the rotor, the disclosure provides that a replaceable motor exchange insert which fits in size to the particular motor can be arranged inside the rotor hub. This increases the variability of the construction and reduces the costs for different models.

The axial fan of the disclosure is not limited to the adaptation of the housing in the region of the rotor. Rather, it is provided that a diffusor is integrally arranged in the outlet region on the housing in order to ensure the recovery of pressure. The transition of the housing from the wall ring region to the diffusor is rounded off in a preferred embodiment.

It is furthermore advantageous for a follower guide wheel to be inserted in the outlet region of the housing for comparatively high counterpressures in the axial fan of the invention, which wheel can be optionally retrofitted.

One embodiment of the disclosure furthermore provides as contact protection that a protective grid is used on the housing in the outlet region. The protective grid can be designed as an insert into the diffuser and can comprise meshes or rings which fit in terms of shape and size.

Furthermore, an embodiment with an integral rotor is advantageous. An advantageous embodiment of the disclosure provides that the blades are profiled or crescent-shaped.

According to the disclosure, a rotor made of injection-molded plastic or of aluminum die cast metal is proposed as an advantageous manufacturing process.

Other advantageous further developments of the disclosure are represented in detail in the following together with the description of the preferred embodiment of the disclosure in reference to the figures.

DRAWINGS

DESCRIPTION

Figure 1:
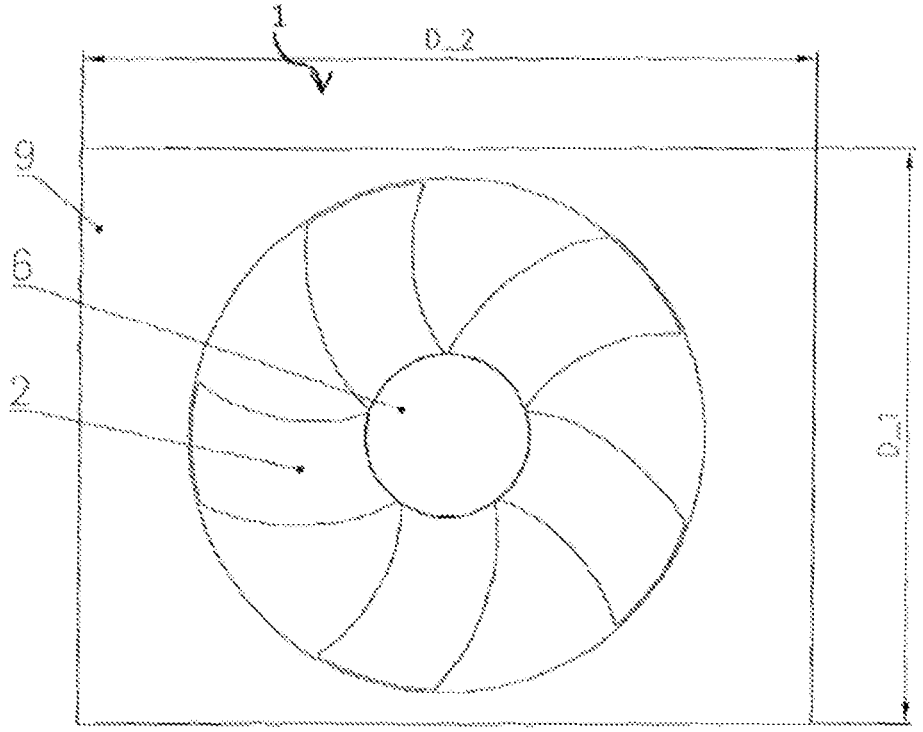
FIG. 1 shows a front view of an axial fan with wall ring plate.

The figures are schematic examples. The same reference numerals designate the same parts in all views. The outside dimensions and diameters designated above and in the claims as $D_1$, $D_A$, $D_L$, $D_{WR}$, $D_{standard}$ are characterized in the figures and in the following by underlining, i.e., as D_1, D_A, D_L; D_WR, D_standard.

FIG. 1 shows a front view of a low-pressure axial fan 1 with a rectangular wall ring plate 9 integrally formed thereon, which plate has side edge lengths D_2 and D_1 (D1>D2), wherein the top view is in the direction of flow, and the rotor 20 constructed with five rotor blades 2 extending radially outward from the hub 6 is apparent at the center of the axial fan 1. The wall ring plate 9 has standard dimensions and forms a structural unit with the axial fan 1 which makes possible a direct exchange with existing systems, for example, in condensers, heat exchangers, refrigerating systems and the like.

Figure 2:
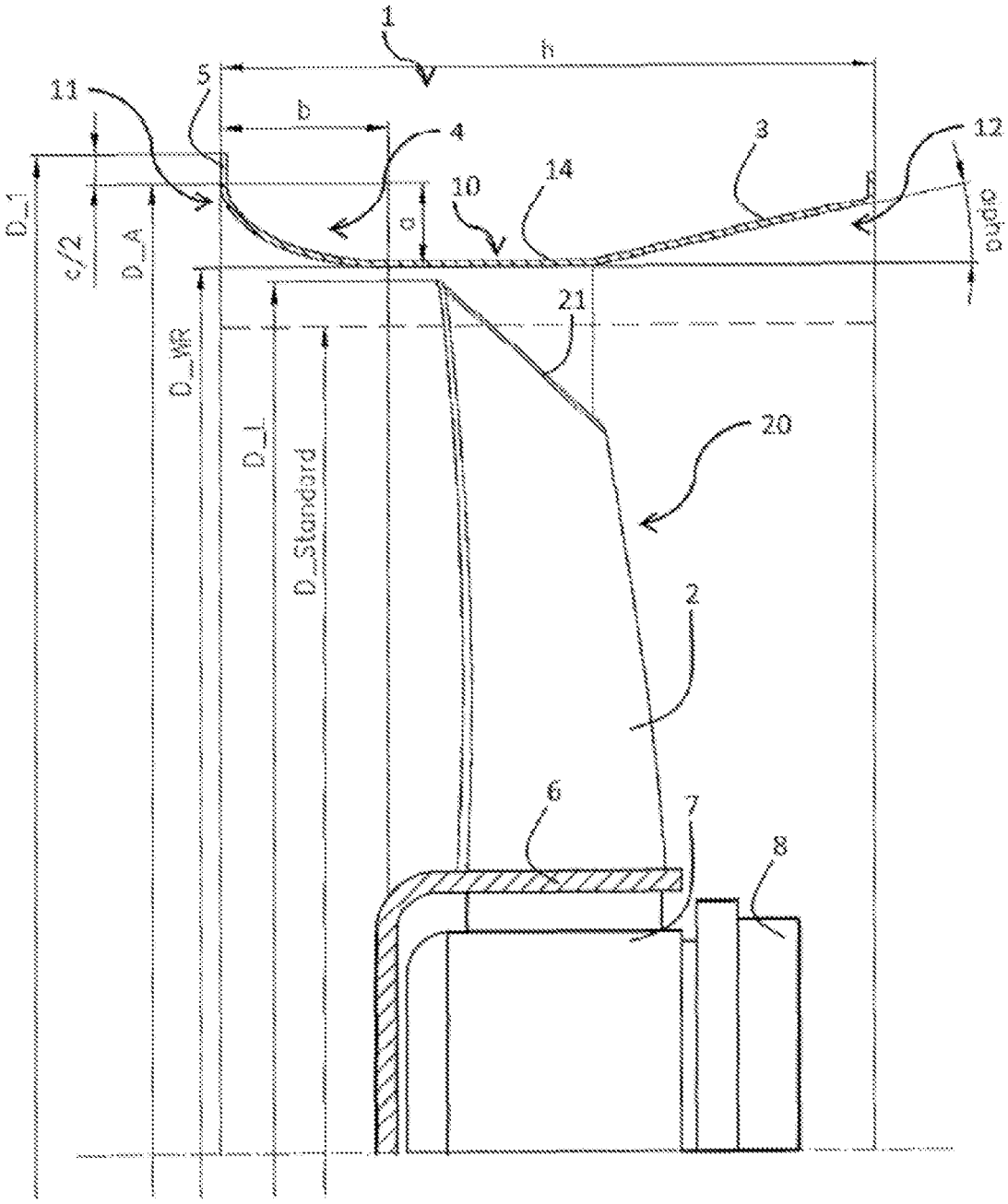
FIG. 2 shows a three-dimensional, partially sectioned view of one half of the axial fan from FIG. 1.

FIG. 2 shows one half of the axial fan from FIG. 1 in a three-dimensional, partially sectioned view. It is understood that the half opposite the axial central line is configured as an identical mirror image. The axial fan 1 comprises a motor 8 configured as an external rotor arranged inside the hub 6 and connected to the rotor 20 by a motor replacement insert 7 which fits the dimension of the motor 8. The motor replacement insert 7 can be detachably fastened to the hub 6. The motor 8 drives the hub 6 and therefore the rotor 20 via the motor replacement insert 7.

The housing 10 of the axial fan 1 comprises an inlet region 11 viewed in the direction of flow from left to right with a maximum outside housing dimension D_1, a tapered section 4 which is arched in a partially elliptical manner in cross section, a middle section 14 extending axially horizontally, and an outlet region 12 constructed with a diffusor 3. The opening angle "alpha" of the diffusor 3 is approximately 12 degrees. The total axial length of the axial ventilator 1 is designated as h. The rotor 20 is arranged in the axial fan 1 substantially at the level of the middle section 14, wherein a vertical plane on the boundary between the middle section 14 and the diffusor 3 intersects the rotor 20 in a radial direction. Each blade 2 of the rotor 20 has a winglet 21 extending along the axial outer edge at its radial end section.

The rotor 20 furthermore comprises a rotor diameter D_L which is increased in comparison with a standardized rotor diameter D_standard based on DIN 323 and ISO 3, so that the ratio of D_1/D_L is smaller than the ratio of D_1/D_standard. The exit surface of the axial fan 1 is increased by the increase in the diameter of the rotor 20 in comparison with the standardized rotor diameter D_standard, as a result of which its dynamic exit losses are reduced and the efficiency is increased. In the embodiment shown, the rotor diameter D_L is approximately 10% greater than the standardized rotor diameter D_standard.

In the inlet region 11, on the inlet side, an outer edge region 5 extending from the outside housing diameter D_1 to the inlet diameter D_A in a radially vertical manner over a length c/2 is formed, which is followed by the tapered section 4, as viewed in the direction of axial flow. The radial length c of the outer edge region 5 results from the difference of the outer housing dimension D_1 and the definable inlet diameter D_A. The axial width b and the radial length a of the tapered section 4 form a ratio of a/b which in the embodiment shown corresponds to approximately a value of 0.5. The lengths a and b are measured taking into account the wall thickness of the housing 10. The length b ends at the point at which the housing 10 merges into the totally horizontal middle section 14, i.e., no arched form of the tapered section 4 can be identified. The length a ends at the point at which the housing 10 merges into the totally vertical outer edge area 5, i.e. no arched form of the tapered section 4 can be identified. The axial end of the tapered section 4 in the direction of flow forms a vertical plane which coincides substantially with the front edge of the hub 6 in the embodiment shown.

Figure 3:
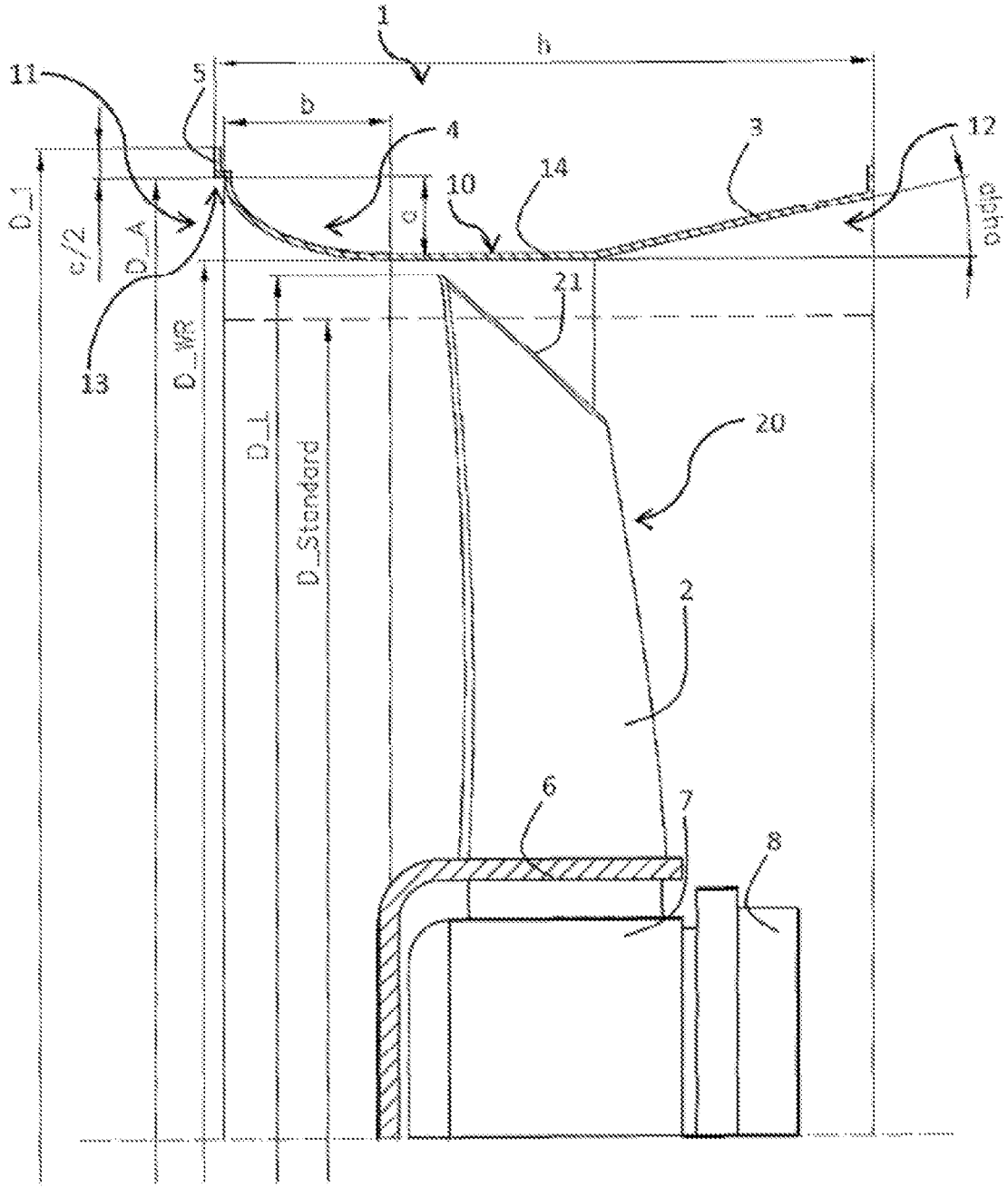
FIG. 3 shows an alternate embodiment of the axial fan from FIG. 2.

FIG. 3 shows, as an alternative to the embodiment according to FIG. 2, an embodiment in which all features are identical; however, a reinforcement web 13 for reinforcing the inlet region 11 is additionally formed on the housing 10 of the axial fan 1 in the inlet region 11 in-between, i.e., in the transition from the outer edge region 5 to the tapered section 4. In this embodiment, the measure a of the tapered section 4 can be determined even more easily since it extends up to the axial inside of the axially horizontal reinforcement web 13.

Figure 4:
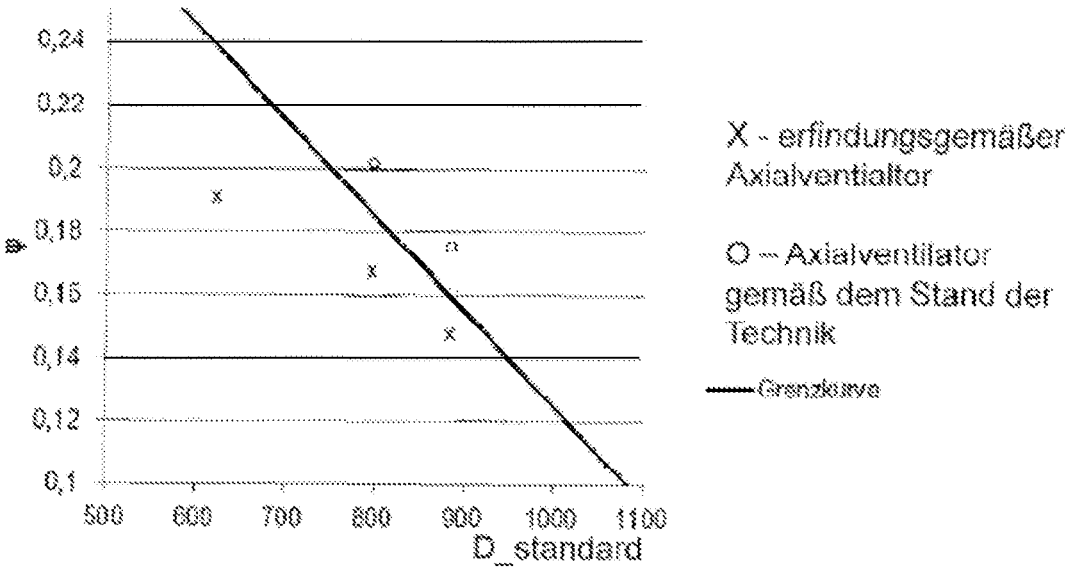
FIG. 4 shows a diagram of the pressure number achieved according to the disclosure.

FIG. 4 shows the reduction of the pressure number ψ of the axial fan 1 according to the disclosure against those of the prior art with respect to the standardized rotor diameter D_standard. The static efficiency optimum of the axial ventilator 1 according to the invention is surprisingly at a pressure number value of $\psi \leq -0.0003 \times D_standard + 0.425$, i.e., on or below the boundary curve sketched in the diagram, whereas the rotors according to the prior art, with and without a follower guide wheel, are always above the boundary curve.

The disclosure is not limited in its execution to the above-indicated, preferred exemplary embodiments. Rather, a number of variants are conceivable which make use of the presented solution even with embodiments of a fundamentally different design. For example, the number of blades of the rotor is not limited to five and may instead range from 3 to 13, in particular 4 to 7. Furthermore, a follower guide wheel which is not shown in the figures can be used to optimize the flow and a protective grid can be used as contact protection.

The invention claimed is:

1. An axial fan and an integral wall ring plate, the axial fan comprising a motor, a one piece housing includes two ends with three axially adjacent abutting regions, an inlet region, a cylindrical region and an outlet diffuser region, the inlet region is at one end extending from the wall ring plate and the outlet diffuser region is at the other end and the cylindrical region is extending immediately between the inlet and outer regions, and a rotor which can be driven by the motor, the rotor has a hub that receives the motor, wherein the housing, on the inlet side, has an outer housing dimension (D1) and the rotor has an increased non-standard sized rotor diameter ($D_L$) as compared with a rotor diameter (D_standard) which is standardized based on the standard series R20 of the DIN standard 323 or the ISO 3 standard, so that a ratio of $D_1/D_L$ is less than a ratio of $D_1/D_{standard}$;

the rotor diameter ($D_L$) is increased by the factor g with a constant outer housing diameter ($D_1$) as compared with the standardized rotor diameter ($D_{standard}$), wherein a factor g is defined in a range of $g_{min}$ to $g_{max}$, wherein $$g_{min} = -0.00008 \times D_{standard} + 1.1 \text{ and}$$

$$g_{max} = -0.00022 \times D_{standard} + 1.34;$$

on the inlet side, the inlet region has a tapered section that narrows in an arched manner in a cross-sectional view from an inlet diameter ($D_A$) to a wall ring diameter ($D_{WR}$) that defines the cylindrical region, an axial end of the tapered wall section at approximately the wall ring diameter in the direction of flow forms a vertical plane coinciding substantially with a front edge of the hub, such that, axially the hub, with its front edge and a portion of fan blades, extend axially along the cylindrical region defined by the wall ring diameter, an axial width (b) and a radial length (a) of the tapered section form a ratio of (a)/(b) in a range from 0.4 to 0.6;

the motor is configured as an external rotor motor, a motor replacement insert is arranged inside the hub and different motors with different motor diameters can be connected to the insert.

2. The axial fan according to claim 1, wherein the wall ring plate has outer dimensions and is round or rectangular, wherein in the case of a rectangular configuration, its shorter side edge and in the case of a round configuration its total diameter corresponds to the outer housing dimension ($D_1$).

3. The axial fan according to claim 1, wherein the wall ring plate is integrally formed on the housing.

4. The axial fan according to claim 1, wherein, on the inlet side, the inlet region of the housing has an outer edge region extending from the outer housing dimension ($D_1$) to the inlet diameter ($D_A$) in a radial manner over a length (c), the outer edge region is followed by the tapered section, as viewed in the direction of axial flow.

5. The axial fan according to claim 4, wherein the outer edge region extending radially over the length (c) is determined from the difference of the outer housing dimension ($D_1$) and the inlet diameter ($D_A$).

6. The axial fan according to claim 4, wherein a reinforcement web is formed between the outer edge region and the tapered section.

7. The axial fan according to claim 1, wherein the factor g is defined in the range of $g_{min}$ to $g_{max}$, wherein $$g_{min} = -0.00008 \times D_{standard} + 1.1 \text{ and}$$

$$g_{max} = -0.00022 \times D_{standard} + 1.088.$$

8. The axial fan according to claim 4, wherein the housing has an inlet geometry in which a ratio j of the axial width (b)

to the outer edge region extending radially vertically over the length (c) is defined in a range of $j_{min}$ to $j_{max}$, wherein $$j_{min}=-0.0047\times D_{standard}+6.5225, \text{ and}$$

$$j_{max}=-0.0054\times D_{standard}+8.8135.$$

9. The axial fan according to claim 8, wherein the ratio j is defined in the range $j_{min}$ to $j_{max}$, wherein $$j_{min}=-0.0047\times D_{standard}+6.5225, \text{ and}$$

$$j_{max}=8.$$

10. The axial fan according to claim 1, wherein the rotor comprises a plurality of blades, with a winglet being integrally formed on the radial outer region of each blade.

* * * * *